US005653499A

United States Patent [19]

Goodall

[11] Patent Number: 5,653,499

[45] Date of Patent: Aug. 5, 1997

[54] CHAIR BRACKET SUPPORTING KEYBOARD AND MOUSE PLATFORMS

[76] Inventor: Kirk Bryant Goodall, 84 Forest Rd., Wolfeboro, N.H. 03894

[21] Appl. No.: 347,049

[22] Filed: Nov. 30, 1994

[51] Int. Cl.[6] ..... A47B 83/02

[52] U.S. Cl. ..... 297/170; 297/173; 297/411.35

[58] Field of Search ..... 297/411.35, 411.36, 297/411.37, 411.38, 411.27, 170, 172, 173, 174, 144

[56] References Cited

U.S. PATENT DOCUMENTS

| | | | |
|---|---|---|---|
| 319,105 | 6/1885 | McClure | 297/170 X |
| 326,185 | 8/1885 | White | 297/411.37 X |
| 389,952 | 9/1888 | Byrkit | 297/170 X |
| 527,056 | 10/1894 | Gilson | 297/411.36 X |
| 564,667 | 7/1896 | Vinbruex et al. | 297/411.35 X |
| 646,835 | 4/1900 | Jackson | 297/170 |
| 1,324,503 | 12/1919 | Hirsch | 297/170 X |
| 1,663,781 | 3/1928 | Spargo | 297/170 |
| 1,706,634 | 3/1929 | Seils | 297/411.35 X |
| 4,586,748 | 5/1986 | Dingler et al. | 297/411.38 X |
| 4,815,688 | 3/1989 | Wood | 297/411.21 X |
| 4,913,393 | 4/1990 | Wood | 297/411.37 X |
| 5,158,074 | 10/1992 | Grellas | 297/188.21 X |
| 5,161,766 | 11/1992 | Arima | 297/174 X |
| 5,281,001 | 1/1994 | Bergsten et al. | 297/411.35 X |
| 5,407,249 | 4/1995 | Banutti | 297/411.35 |

*Primary Examiner*—Peter R. Brown
*Assistant Examiner*—David E. Allred

[57] ABSTRACT

A system of brackets that attach to a typical office chair which support platforms for a keyboard and mouse. The bracket system attaches to the pedestal of a chair and allows for adjustment of the position of the keyboard and mouse platform along all three axis's. The bracket system allows the keyboard and mouse platforms to be mounted from either the left or right side of the chair. The bracket system is designed to support a keyboard and mouse, but the keyboard platform could also be used as a writing surface, or the mouse platform could serve as an arm rest.

3 Claims, 12 Drawing Sheets

CHAIR BRACKET SUPPORTING KEYBOARD AND MOUSE PLATFORMS

BACKGROUND—FIELD OF INVENTION

This invention relates to a system of brackets to mount a keyboard and mouse pad onto a standard office chair. The invention allows the keyboard and mouse to be independently positioned a suitable distance and angle from the operator so that the greatest possible comfort is obtained.

BACKGROUND—DISCUSSION OF PRIOR ART

The general field of integrating computer peripheral devices, such as keyboards and mice, into chairs has been developing over the past ten years. However, the systems proposed in the body of prior art have either been too limited to meet all of the needs of the user, or they have been too cumbersome to manufacture and sell economically, or they do not provide enough flexibility to be used in a typical office setting.

U.S. Pat. No. 4,779,922 to Cooper teaches the integration of a complete workstation with a specialized chair. The device fails to provide support for a mouse independent from the support of the keyboard. Furthermore, the workstation is supported on a arm cantilevered from the chair. This requires a large base on the specialized chair to keep the chair from tipping over. Furthermore, the cantilevered design can support a workstation of only limited weight.

U.S. Pat. No. 5,022,706 to Bryan teaches a chair with a keyboard support table, the device requires two support tables for the keyboard and fails to provide for rotational adjustment along all three axis's. It requires that a specialized chair be constructed to accommodate the support tables. Furthermore, the device does not provide independent support for a mouse.

U.S. Pat. No. 5,022,706 to Fricano teaches a keyboard support that rotates into position over the lap of the user. Since the primary pivot point is affixed to the bottom of the chair, the keyboard can be rotated in from only one side of the chair. In addition, the device does not provide a means for the keyboard to rotate upwardly or downwardly to allows for additional adjustment. Furthermore the devices does not provide a method of independently supporting a mouse or stylist pad. However, perhaps the greatest short-comming, is that the proposed system is not adjustable and therefore cannot be easily affixed to a wide variety of chairs.

OBJECTS AND ADVANTAGES

It is accordingly a primary object of the present invention to provide a system of brackets that will attach to a wide variety of office chairs and will provide support for a mouse and keyboard.

A further object of the present invention is to provide a mechanism for allowing the keyboard to be rotated and transversely adjusted along all three axis's.

It is another object of the present invention to provide an independent method for supporting a mouse pad or stylist pad and to provide a mechanism for rotating and transversely adjusting the mouse pad support along all three axis's.

It is still a further object of the present invention to provide flexibility in the manner in which the system of brackets are attached to the chair so that keyboard may be rotated inwardly from the left or from the right, or that the keyboard may be rotated upwardly to the left or to the right.

It is yet a further object of the present invention that mouse pad may be position on the left or right hand side of the chair to accommodate left and right handed people.

DRAWING FIGURES

DESCRIPTION OF THE PREFERRED EMBODIMENT

Figure 1:
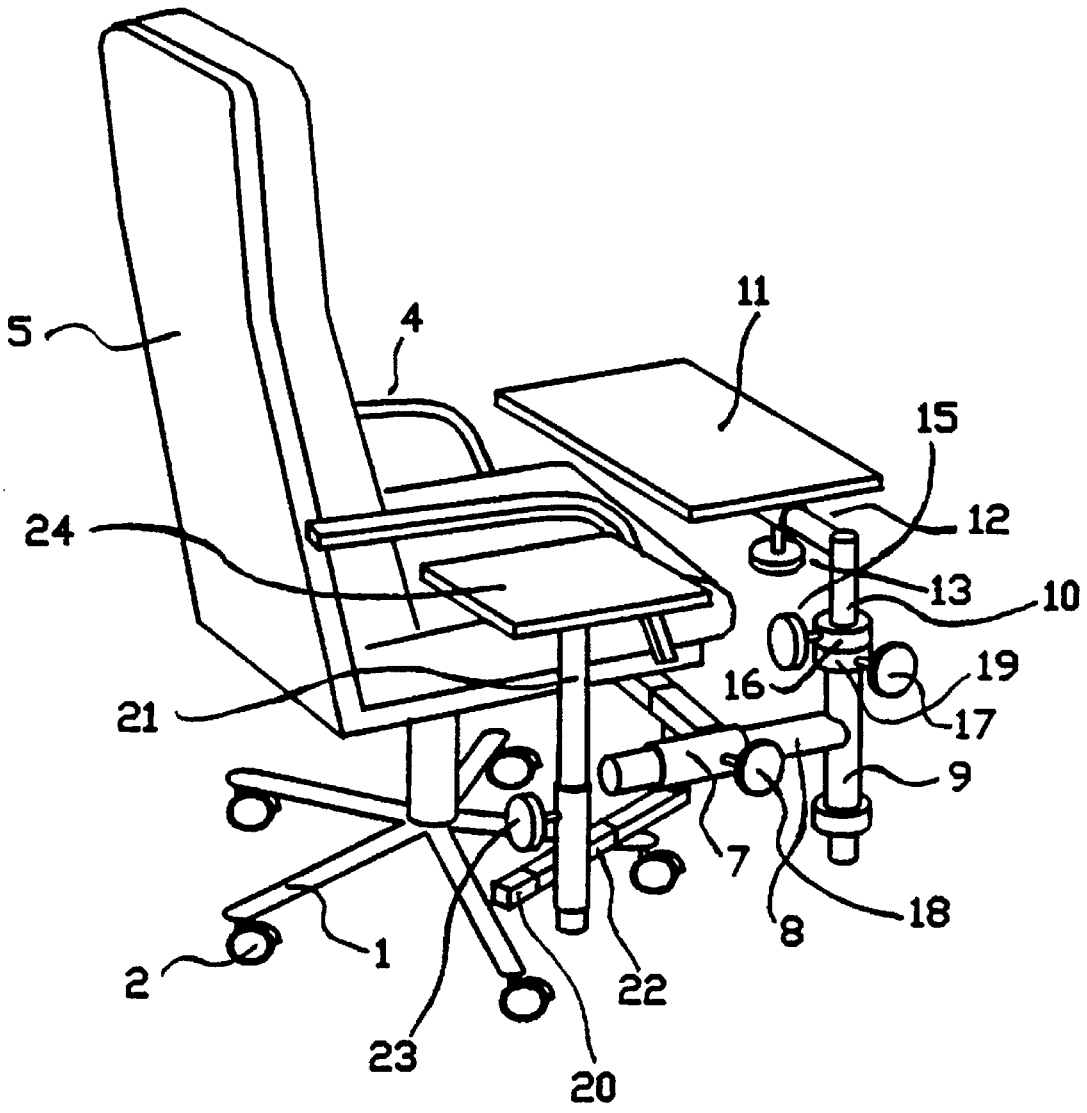
FIG. 1 is a pictorial view of a typical office chair with the brackets for support of a mouse and keyboard mounted on the right hand side of the chair.

FIG. 1 depicts a conventional office chair and a standard pedestal which supports the seat structure. This chair which is well known in the prior art is composed of the following components: A five-leg base 1 with each leg support by a rolling caster 2. A support pedestal 3 is mounted in the center of the five legged base and supports the seat structure substantially in the middle thereof. The standard pedestal permits the adjustment of height as well as angle of the seat structure with respect to the floor. The pedestal also permits the seat to swivel about the vertical center line of the seat. The seat structure also has left and right arms 4 that are positioned sidewardly from the centerline of the chair and project upwardly from the base of the seat structure. The seat structure terminates in a back support structure 5 which projects upwardly from the base of the seat structure.

The structure of the chair in FIG. 1 is conventional and in fact the arrangement illustrated in the drawing has been chosen merely for convenience in illustration. It should be recognized that the overall structure and configuration of the chair may depart significantly from the chair illustrated in the drawings without departing from the present invention, as explained in greater detail below.

Figure 2:
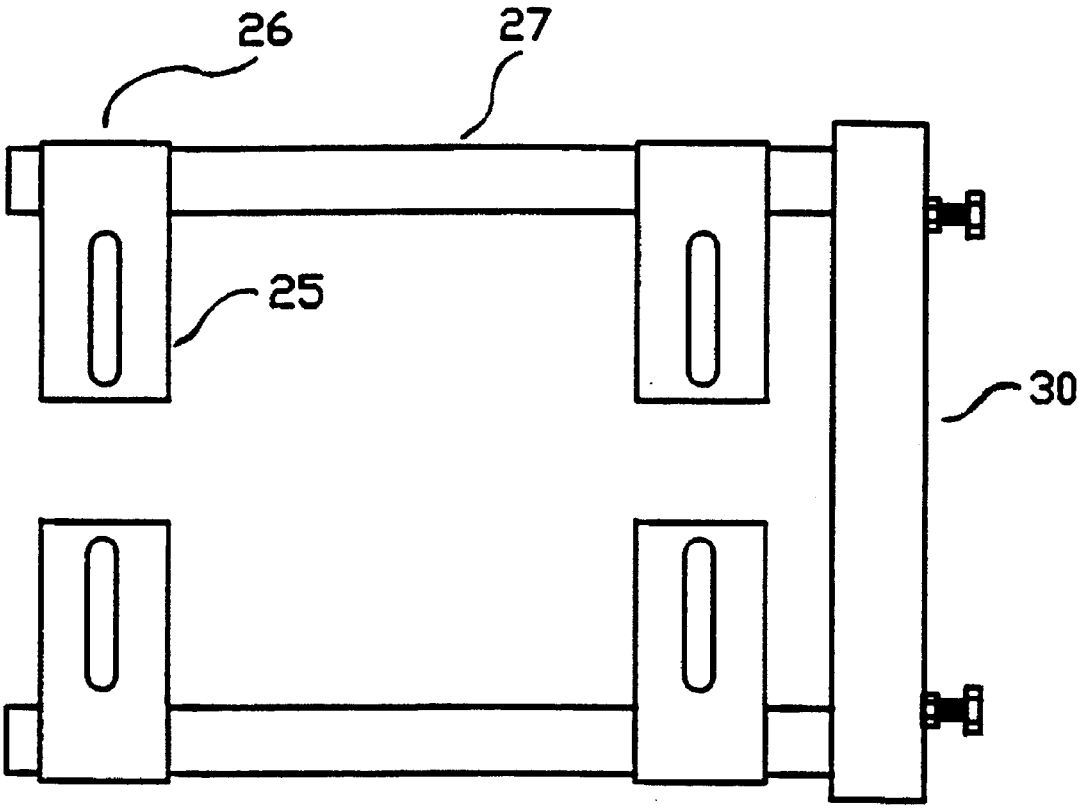
FIG. 2 is a top view of the pedestal bracket which is the central supporting bracket for additional brackets.
Figure 3:
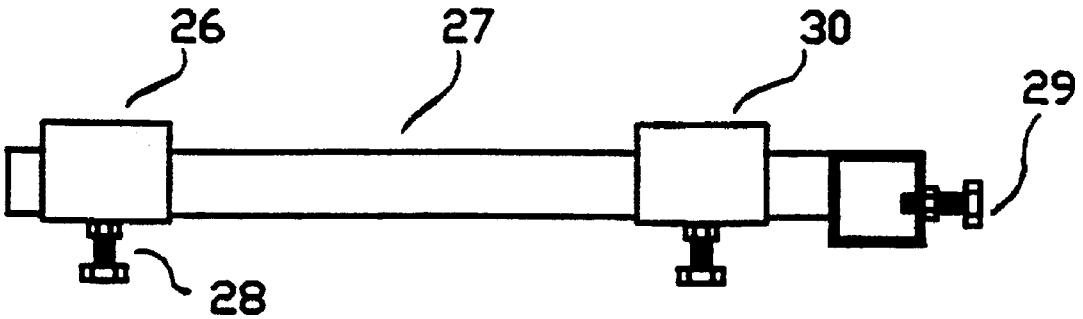
FIG. 3 is a side view of the pedestal bracket.

Therefore, the improvement over prior art is a modular system of brackets that firmly attaches a keyboard and mouse support platform to a standard office chair as previously defined. The central component of the bracketing system is the pedestal bracket as shown in FIG. 2 and FIG. 3. FIG. 2 is a top view of the pedestal bracket showing the sliding tongs 26 that are designed to accommodate pedestals of varying size and configuration. FIG. 3 is a side view of the pedestal bracket. The tongs have oval slots 25 to accommodate pedestals of varying width, and slide along a square tube 27 and then are fixed into position with a clamping bolt 28. The clamping bolt is attached to the sliding tong with a nut which is welded to surface of the sleeve 26 that slides along the square tube 27. The bolt end projects through the sliding tong and makes contact with the surface of the square tube, which effectively bolts the sliding tong into place.

Figure 4:
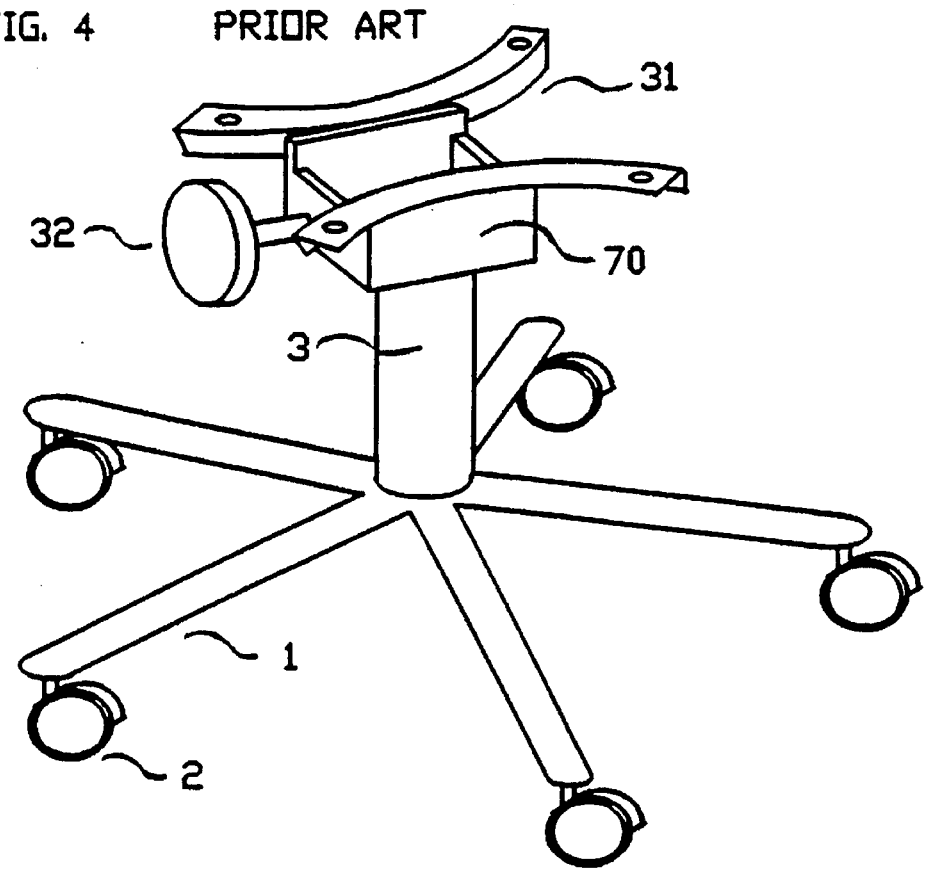
FIG. 4 PRIOR ART
FIG. 4 is a pictorial view of a typical chair pedestal.

FIG. 4 is a a pictorial of a typical pedestal which is part of the office chair previously described. The pedestal is typically composed of a 5 legged base 1 on rolling casters 2. The base is attached to a support column 3, which attaches to a swiveling fixture 70 which attached to the bottom of the chair at four mounting points 31. The inclination is typically adjusted by a knob 32. A method of adjusting height through either a threaded shaft, or a piston column is commonly incorporated into the pedestal support column 3.

Figure 5:
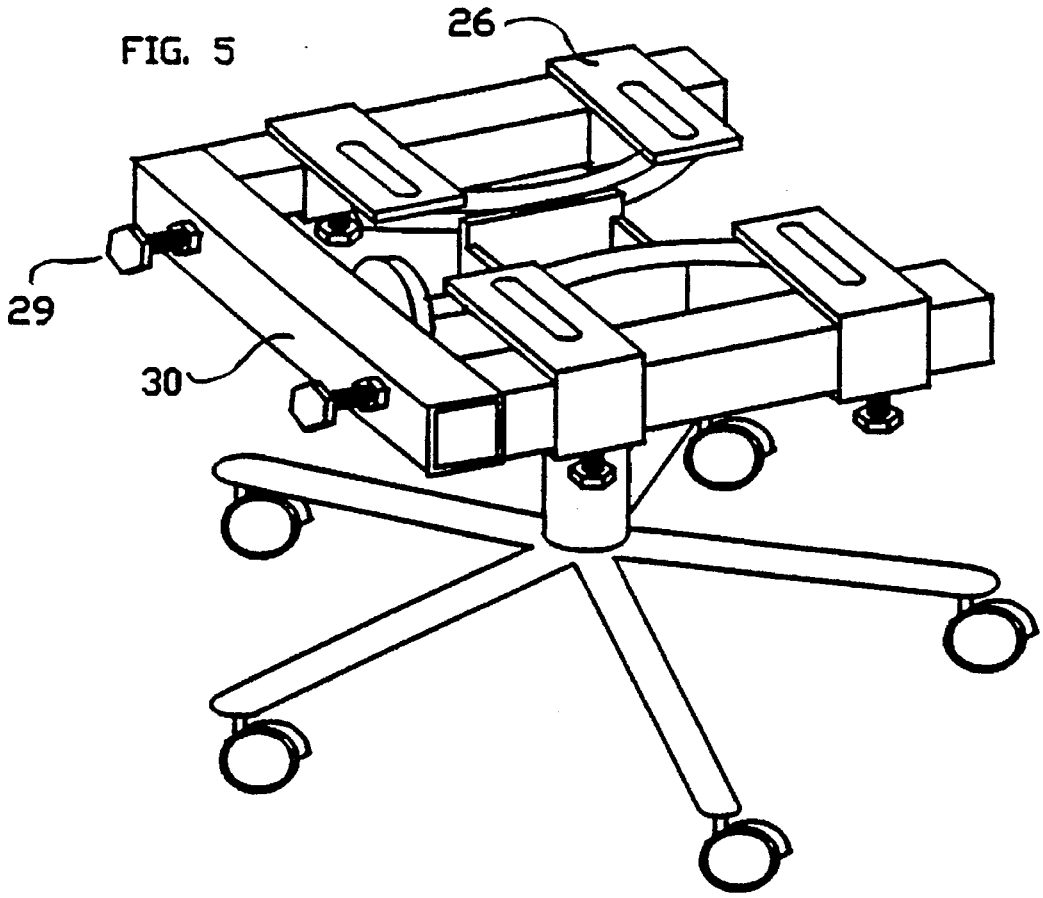
FIG. 5 is pictorial view of the pedestal bracket mounted on top of the pedestal.
Figure 6:
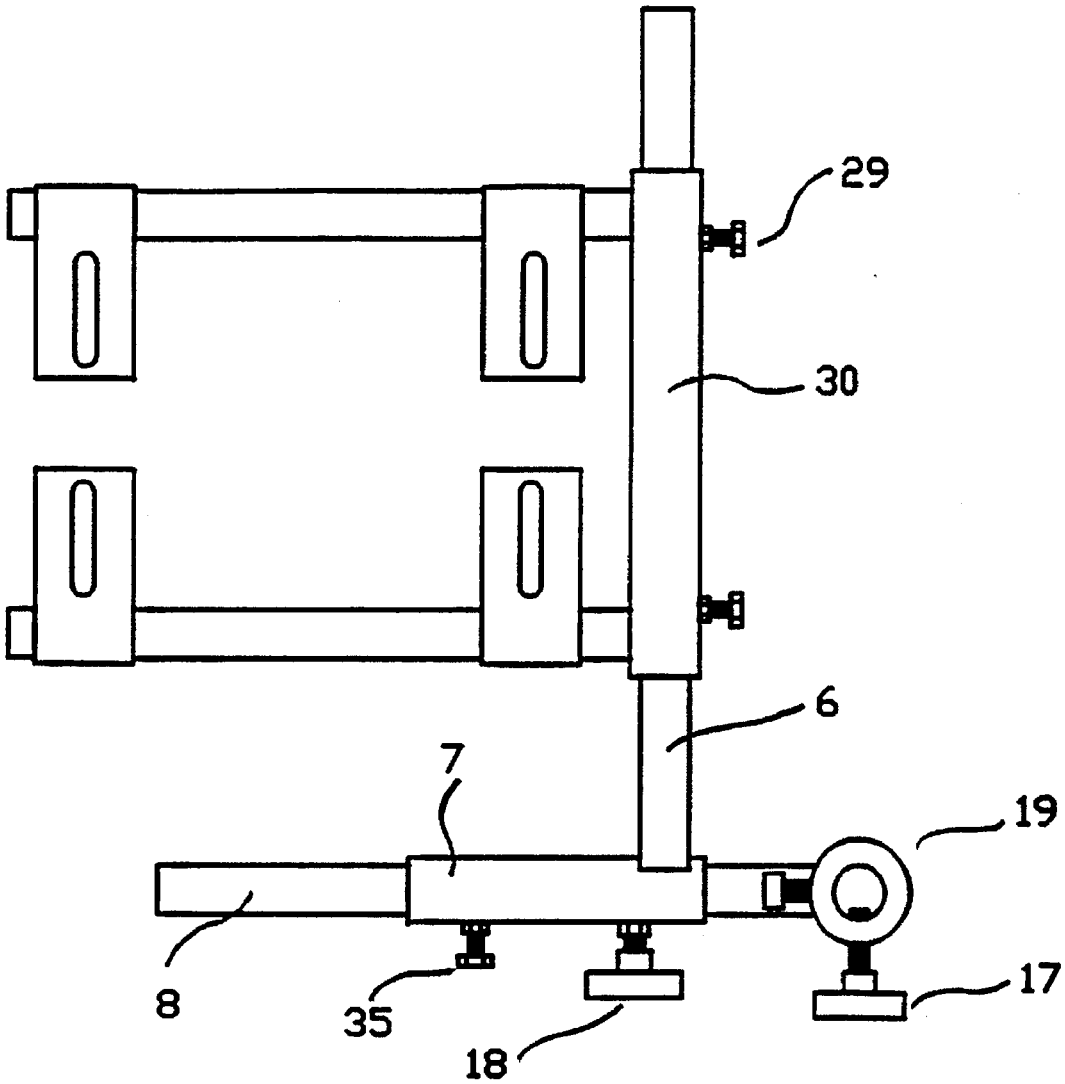
FIG. 6 is a top view of the main support arm and forward slide tube mounted in the pedestal bracket.

The pedestal bracket shown in FIG. 2 is properly adjusted so that the slots line up with the mounting holes 31 shown in FIG. 4 and then placed on top of the pedestal as shown in FIG. 5. The entire assembly shown in FIG. 5 is then mounted to the bottom of the chair with fasteners that go through the oval slots of the sliding tongs of the pedestal bracket. These fasteners are the same as the ones used to attach the pedestal to the bottom of the chair. The square tubular main support arm 6 shown in FIG. 6, is then slid into the square tube 30 of the pedestal bracket. The main support arm is bolted into place with the clamping bolts 29. The clamping bolts project through the square pedestal bracket tube 30 as shown in the side view of the pedestal bracket in FIG. 3. In this manner the clamping bolts of the pedestal bracket make contact with the main support arm and effectively bolt the arm into place as shown in FIG. 6.

Figure 7:
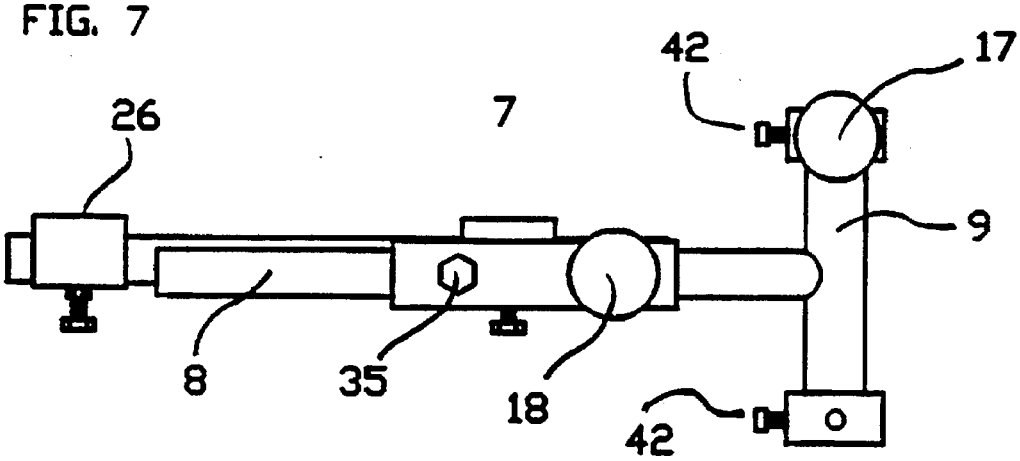
FIG. 7 is a side view of FIG. 6 which shows the forward slide tube mounted in the main side tube sleeve.

The round forward adjustment tube 8 is then slid into the main assembly arm adjustment sleeve, 7 and bolted into position with the clamping knob 18 and clamping bolt 35. FIG. 7 shows a side view of the forward adjustment tube 8 bolted into position in the forward adjustment sleeve 7 with the clamping bolt 35 and clamping knob 18. The clamping knob 18 provides a method of readily adjusting the distance of the keyboard platform outwardly from the chair, and the clamping bolt 35 then firmly secures the forward adjustment tube into position.

Figure 8:
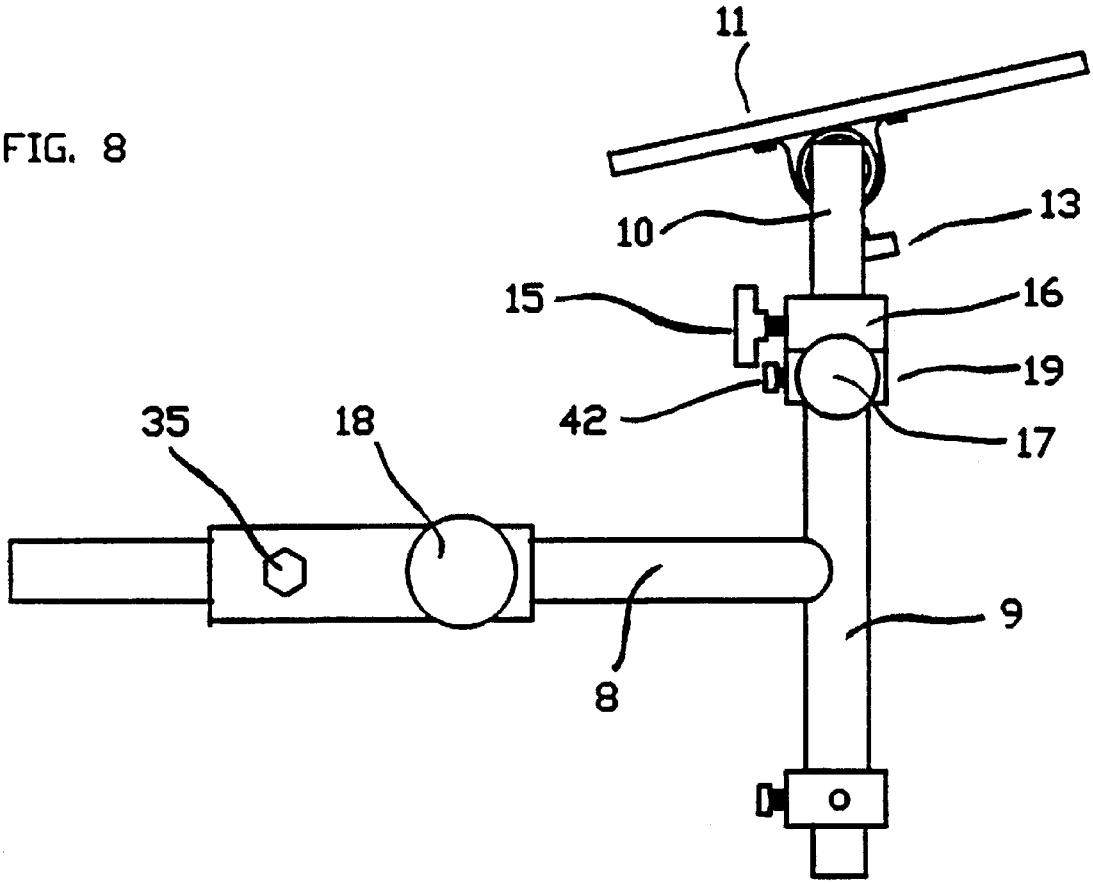
FIG. 8 is side view of the keyboard platform rotation tube mounted in the rotation tube sleeve. Also pictured is a side view of the keyboard platform.

Referring to FIG. 7, the swing arm sleeve 9 is now ready to receive the swing arm tube 10 as shown in FIG. 8. The weight of the swing ann is supported by clamping annuluses 16, and 19. Annulus 16 rides on top of clamping annulus 19. The bottom clamping annulus is affixed to the swing arm sleeve 9 with the clamping bolt 42. The top clamping annulus 16 is clamped to the swing arm tube 10 with the clamping knob 15. An additional clamping knob 17 projects through the bottom annulus 19 and makes contact with the swing arm tube 10. This provides a method locking the swing arm tube into position, or provides a degree of fictional force to inhibit unwanted rotation of the keyboard platform 11.

Figure 9:
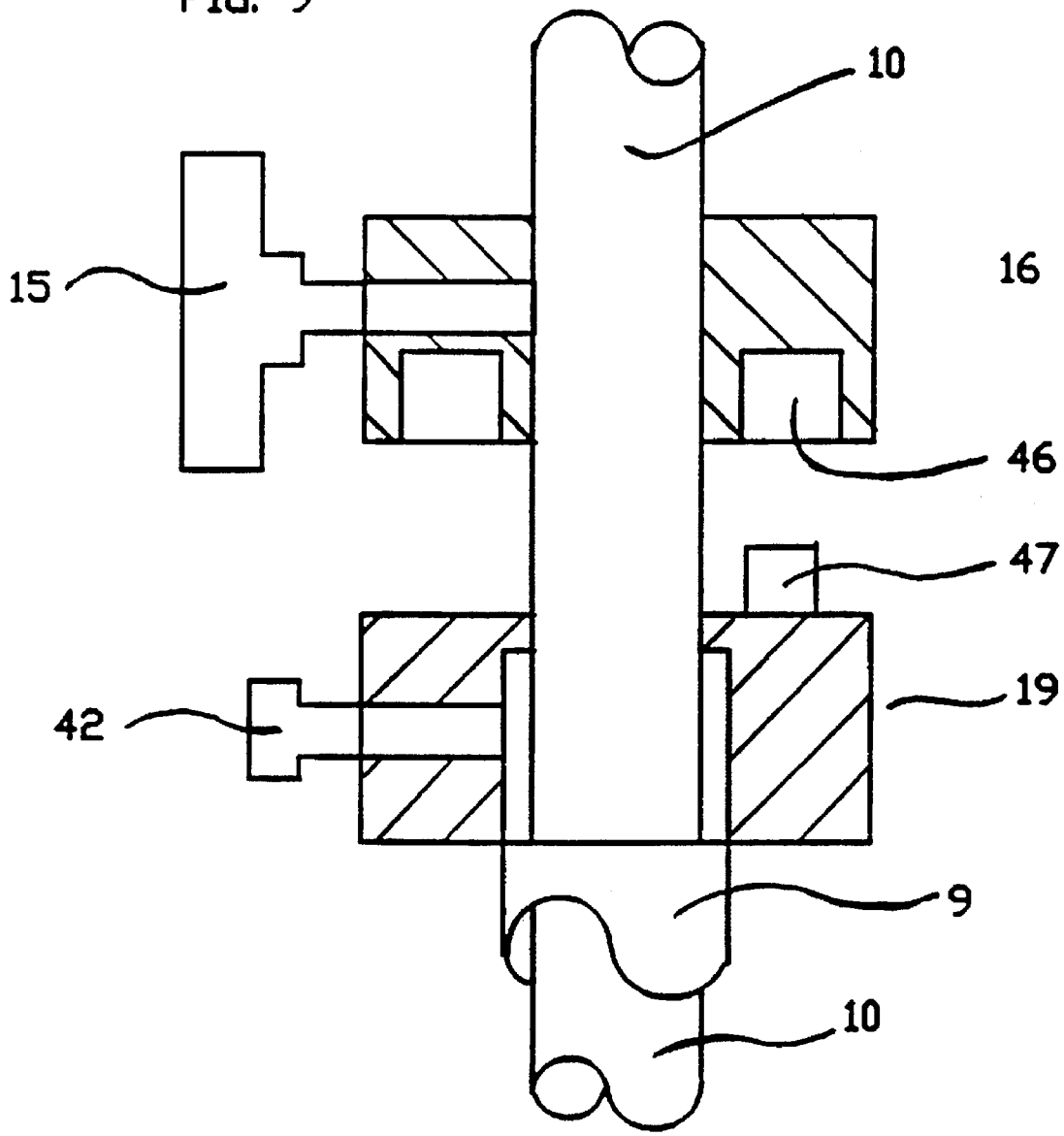
FIG. 9 is a cross section of the clamping annuluses.
Figure 10:
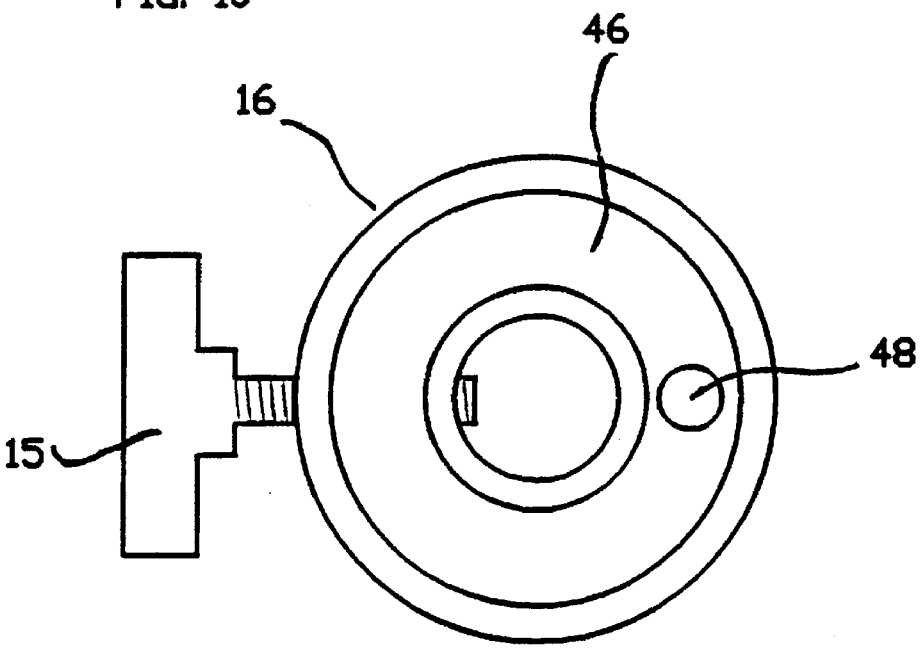
FIG. 10 is a bottom view of the clamping annulus which attaches to the rotation tube.
Figure 11:
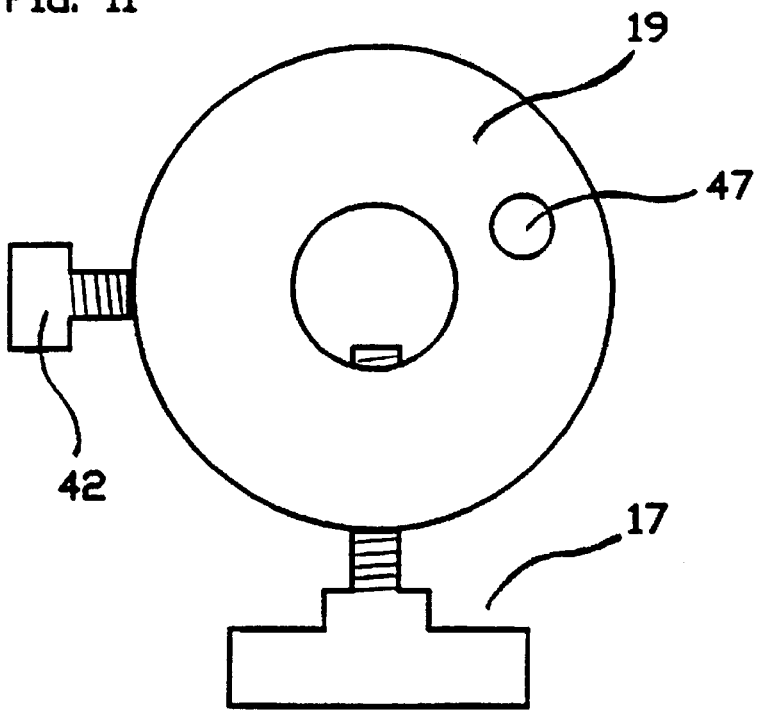
FIG. 11 is a top view of the clamping annulus which attached to the rotation tube sleeve.
Figure 12:
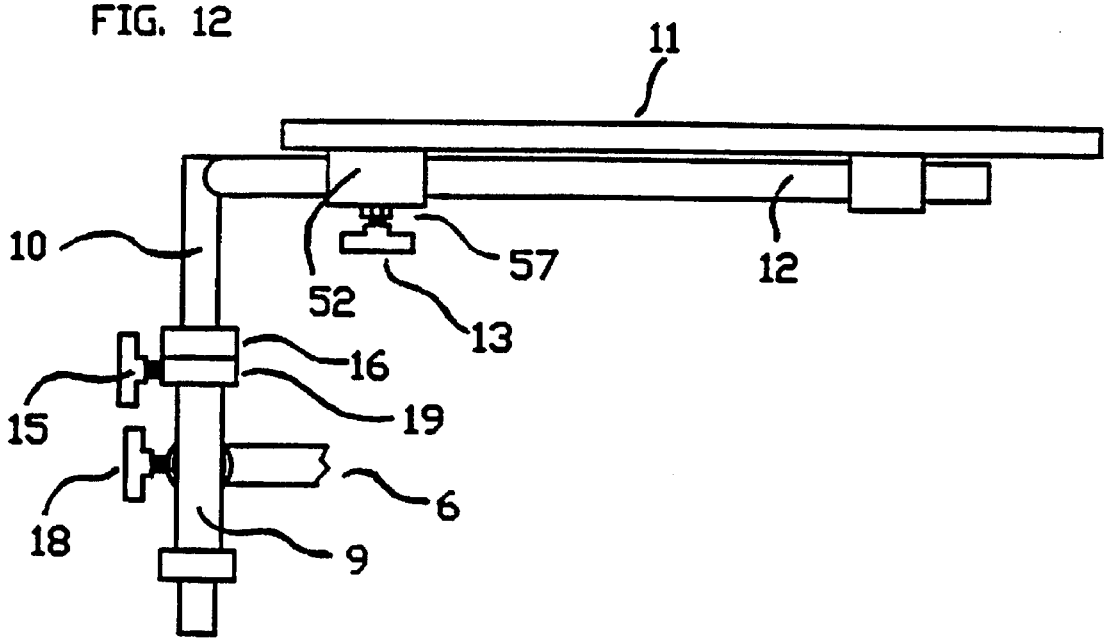
FIG. 12 is a front view of the keyboard platform which is mounted to the keyboard platform support tube which connects to the rotation tube.

A more detailed view of the damping annuluses can be seen in the cross section view shown in FIG. 9. The top annulus 16 has a circular channel 46 cut into it. A protrusion 47 from the bottom annulus 19 fits into the channel 46. As clamping annulus 16 rotates on top of clamping annulus 19, the protrusion 47 makes contact with a stop 48 in the channel 46 of the top annulus 16. The protruding stop 48 in the channel 46 is clearly shown in FIG. 10 which depicts the bottom surface of the annulus 16. FIG. 10 also clearly shows the clamping knob which projects through the annulus to make contact with the swing arm tube 10. The bottom annulus 19 is bolted to the rotational sleeve 9 by the clamping bolt 42. The clamping bolt 42 is also seen FIG. 11 which depicts the top surface of annulus 19. FIG. 11 also clearly shows the clamping knob 17 projecting through the annulus to make contract with the rotational swing arm tube 10.

In this manner the top annulus 16 rides on top of the bottom annulus 19 and carries the load of the keyboard platform. In this manner, the keyboard table top is permitted to swing and stop when protrusion 47 makes contact with protrusion 48 at which point, the keyboard platform will be over the lap of the user. As previously described, clamping knob 17 provides a method of locking the rotational tube 10 in place once the keyboard platform has been swung into the desired position. It should be noted that an alternative method of locking the keyboard into place could be by employing a spring loaded ball which snaps into a depression when the annuluses have reached the correct alignment.

The table top 11 which supports the keyboard is then slid onto the swing arm table support tube 12 through the keyboard platform tube sleeves 52. The keyboard platform 11 is adjusted to the desired angle as shown in FIG. 8 and then clamped into position with the clamping knob 13. The threaded stud of the clamping knob 13 projects through nut 57 welded to the surface of the tube sleeve 52 and makes contact with the support tube 12. In this manner, the angle and lateral position of the keyboard platform is adjusted and fixed into place.

Figure 13:
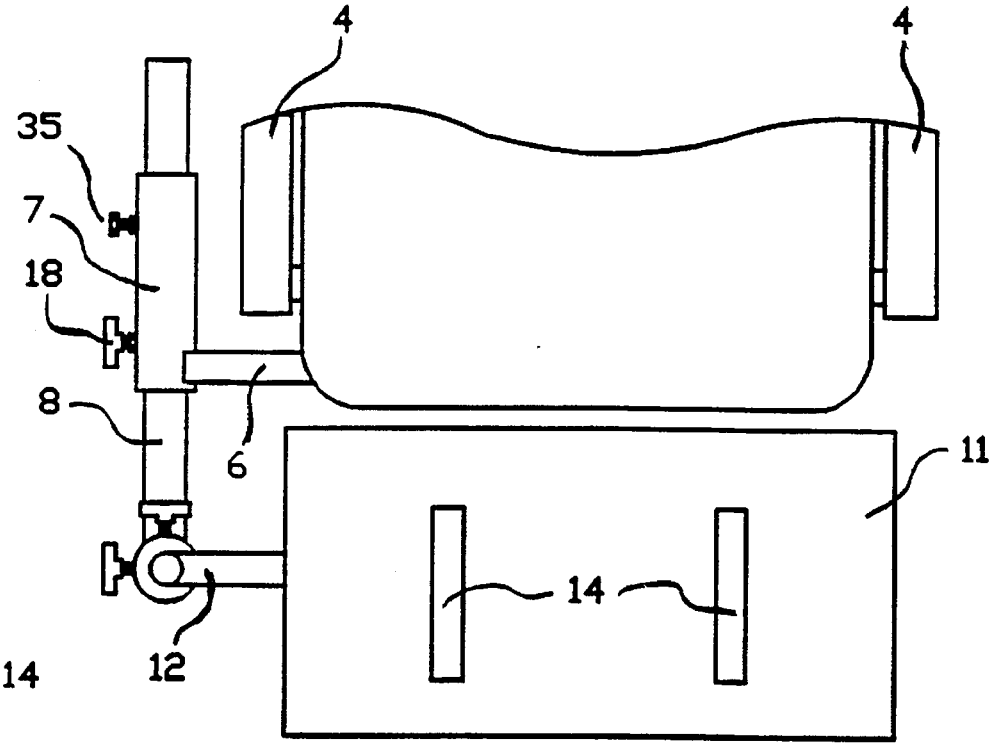
FIG. 13 is a top view of the of a cut away of the chair and the keyboard platform.
Figure 14:
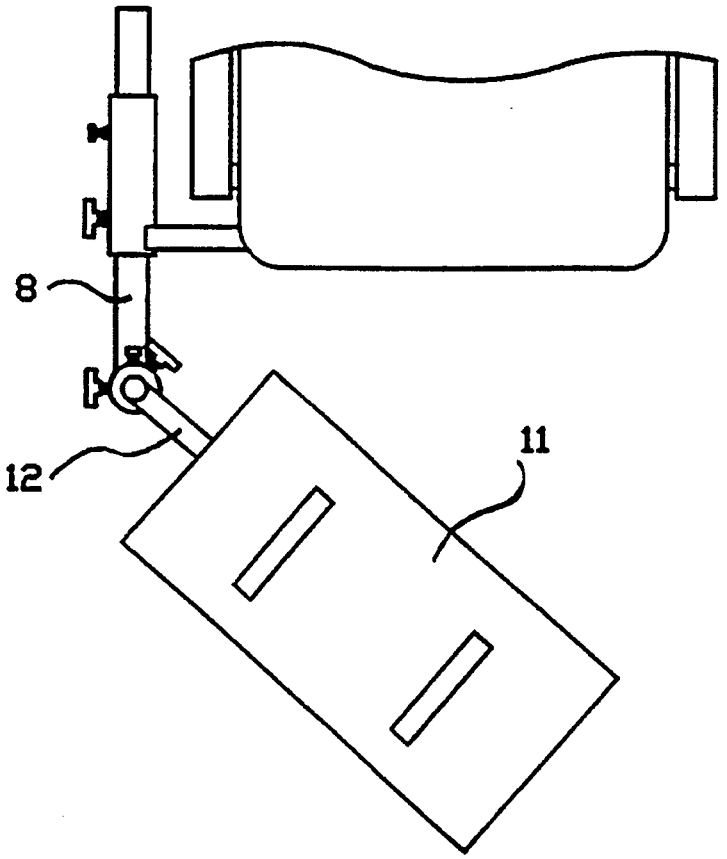
FIG. 14 is a top of FIG. 13 showing the keyboard platform rotated away from the chair.

The completed assembly is shown in FIG. 1. The main support arm 6 can be seen protruding from the bottom of the chair. It terminates at the forward adjustment tube sleeve 7. The forward adjustment tube 8, has been bolted into position with clamping knob 18 and terminates at the rotational arm tube sleeve 9. The rotational arm tube 10 has been clamped into position such that the keyboard platform 11 is suspended over the lap of the operator. Since the keyboard platform rotates about the swing arm table support tube 12, the angle of the table with respect to the forearms can be adjusted and the table clamped into position with the clamping knob 13. Velcro strips 14 shown in FIG. 13 are used to secure the keyboard to the keyboard platform. Clamping knob 15 locks annulus 16 to the swing arm tube and enables annulus 16 to ride on top of the annulus 19, thereby carrying the load of the keyboard platform as it is rotated into position. Once the keyboard platform 11 had reached the desired position, it can be locked into place with clamping knob 17. Looking down from the top, the keyboard table is in the position shown in FIG. 13. When the user wishes to exit the chair, the keyboard table is swung out to the position shown in FIG. 14.

Figure 15:
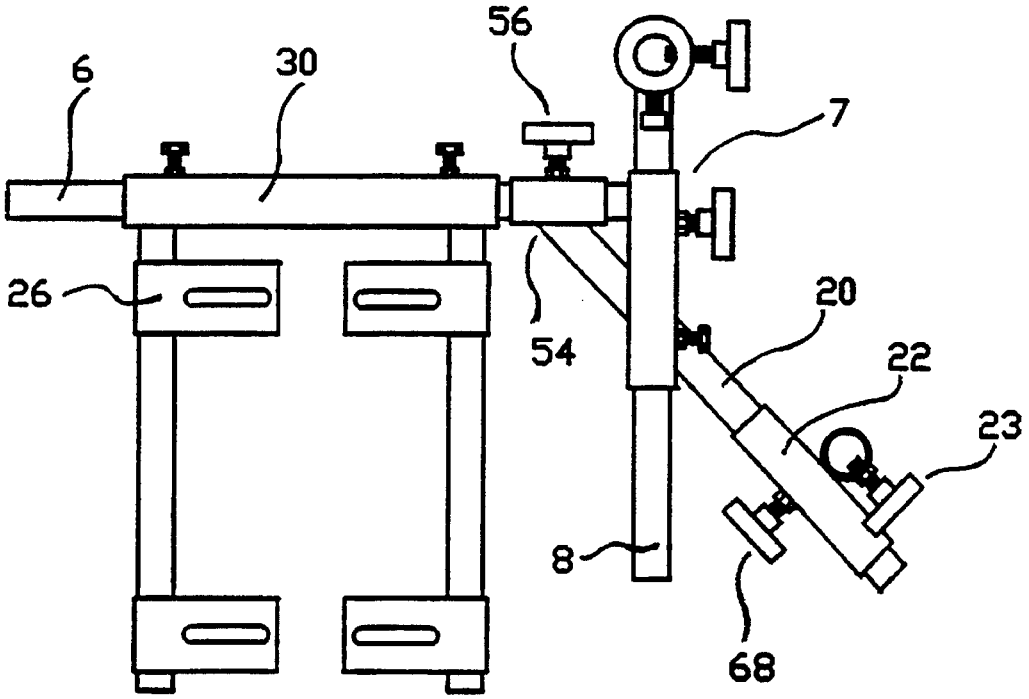
FIG. 15 is a top view of FIG. 6 with the addition of the mouse swing arm and cross sleeves.
Figure 16:
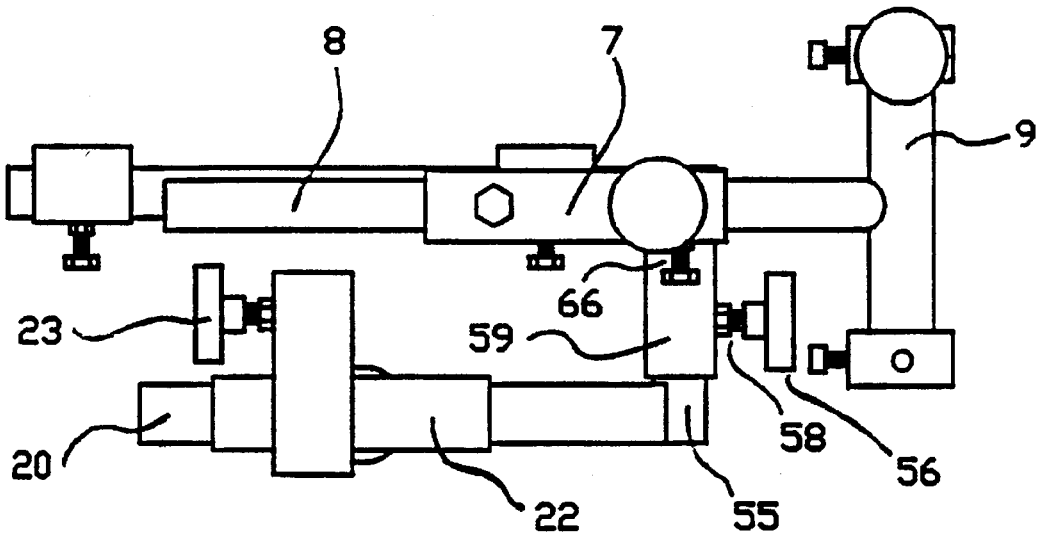
FIG. 16 is a side view of FIG. 15.
Figure 17:
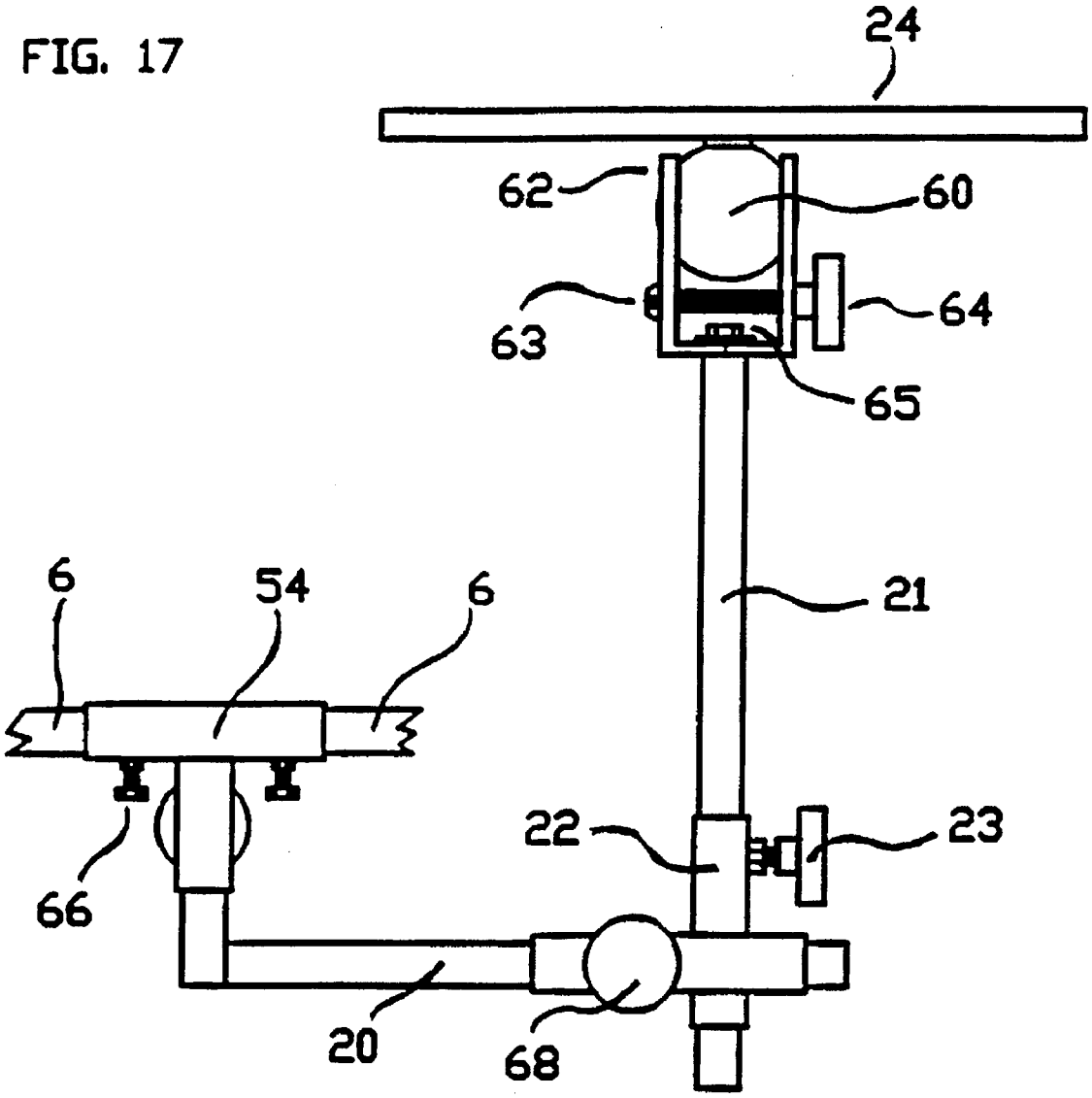
FIG. 17 is a back view of the mouse platform mounted to a break away of the main support arm.

The mouse bracket can be attached to the main assembly arm as shown in FIG. 15. Prior to inserting the main assembly arm into the pedestal bracket, the mouse attachment bracket component 54 is slid onto the main support arm 6 and bolted into position as shown in FIG. 17 with the clamping bolts 66. The mouse swing arm 20 is designed to rotate and clamp into position with the clamping knob 56. The rotational adjustment clamping knob 56 is clearly shown in FIG. 16. The threaded stud of the clamping knob 56 projects through the nut 58 welded to the surface of the rotational sleeve 59 and makes contact with the rotational mouse platform tube 55. The height and distance of the mouse platform from the chair is adjusted with the adjustment cross sleeves 22. It should be noted that the cross sleeves 22 are composed of a round sleeve 69 that holds the mouse support tube 21 and a square sleeve 71 that holds the mouse swing arm 20. The cross sleeves are positioned along the mouse swing arm 20 and then clamped into position with the clamping knob 68. The mouse support tube 21 is then inserted into the support tube sleeve 69 and clamped into position with the clamping knob 23.

Figure 18:
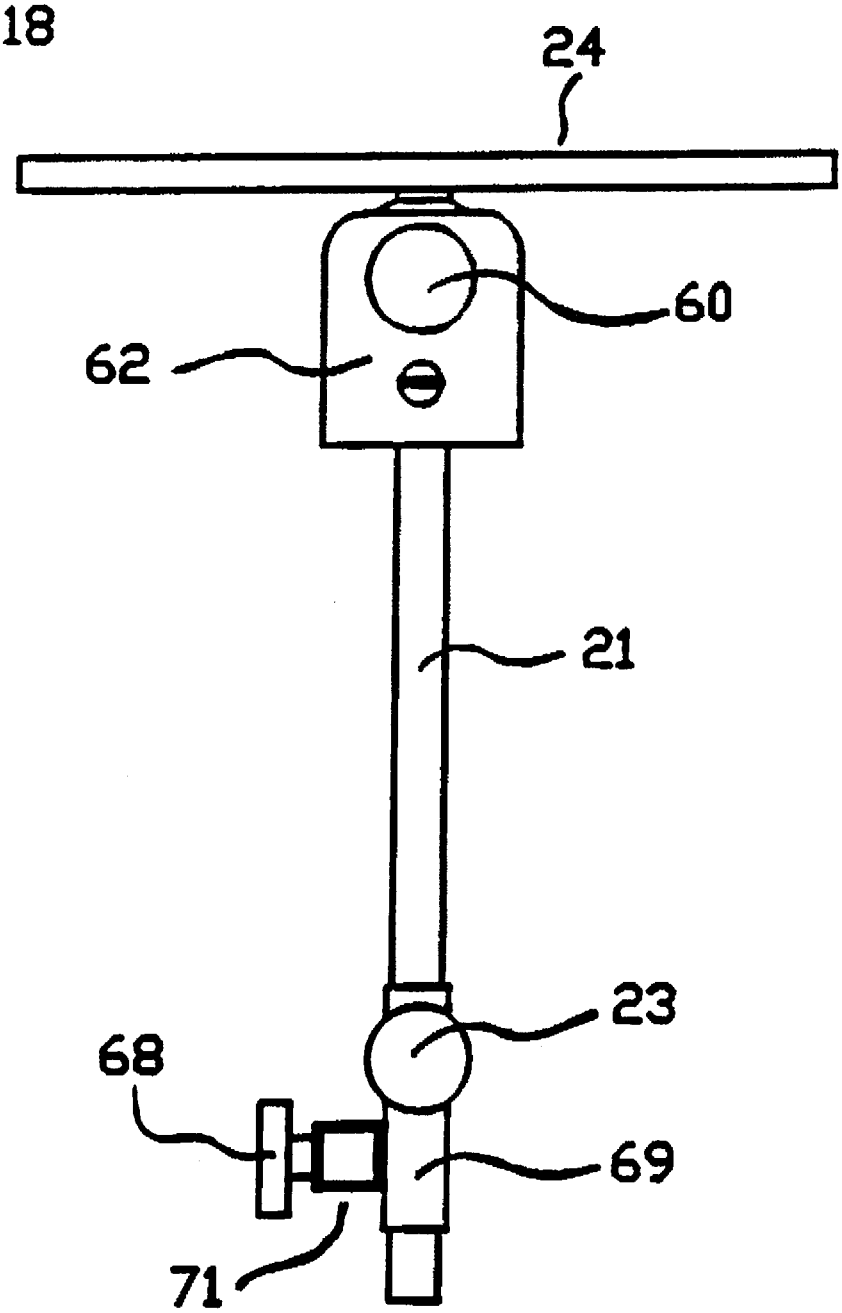
FIG. 18 is a view of the mouse platform, ball joint, support tube, and cross sleeves.

The ball joint assembly shown in FIG. 17 is used to control the angle of the mouse pad with respect to the operator. A plastic ball 60 is fastened to the mouse table top 24. The plastic ball is sandwiched between to pieces of angled metal 62 with round holes to accept the ball 60 as shown in FIG. 18. The two metal angle brackets are drawn together with a bolt 63 and clamping knob 64. The entire assembly is then attached to the support tube with a bolt 65 that is threaded into an insert in the mouse support tube 21. The completed assembly can be seen in FIG. 1. The mouse platform swing arm 20 is bracketed to the main support arm 6. The mouse platform support tube 21 has been inserted into the adjustment cross sleeves 22 and fixed into position with the clamping knob 23. The mouse support tube 21 supports the mouse platform 24.

OPERATION

In the typical mode of operation, the clamping knob 17 is loosened to decrease the friction against the rotation tube 10, at which point the keyboard platform is swung away from the chair. The operator then enters the chair, and pulls the keyboard platform towards himself, until the keyboard platform is over the operator's lap. The height of the keyboard platform over the operators lap can be adjusted by changing the location of the clamping annulus 16 along the rotation tube 10. The angle of the keyboard platform can be altered by loosening clamping knob 13, and rotating the keyboard platform about the keyboard platform support tube 12. Once the keyboard platform has been adjusted to the correct angle and lateral position, the clamping knob 13 is tightened. The distance of the keyboard platform from the user can be altered by loosening clamping knob 18, and the accompanying clamping bolt 35, and then sliding the forward adjustment tube, 8 in the adjustment tube sleeve 7. Once the keyboard platform has been adjusted to the correct distance from the operator, the clamping knob 18 and accompanying clamping bolt 35 are tightened.

The height of the mouse platform 24 can be adjusted by loosening the clamping knob 23 and changing the location of the support tube 21 in the cross sleeve 22. The distance of the mouse platform 24 from the chair can be altered by either rotating the swing arm 20, or sliding the cross sleeves along the swing arm. Frictional force opposing rotation of the swing arm 20 is governed by tightening and loosening the clamping knob 56.

It should be noted that because the because the main support arm and forward adjustment tube assembly are symmetric, the keyboard platform can be mounted so that it swings in from either the left or the right side of the chair. Furthermore, the main support arm 6 protrudes from the pedestal bracket to allow the mouse platform to be mounted on the left side of the chair as well as on the right side of the chair as shown in FIG. 1.

SUMMARY RAMIFICATIONS AND SCOPE

A flexible system of brackets has been developed to allow platforms supporting a keyboard and mouse to be attached to a wide variety of chairs. The system of brackets enables the operator to recline and swivel in the chair while keeping the keyboard and mouse pad in the same position. The mouse platform can be of sufficient size to serve as an armrest in addition to a support surface for a mouse. Furthermore, because the keyboard can be properly positioned, the risk of wrist injury is greatly reduced. Although the keyboard platform is intended to support a keyboard, it could also be used as a writing surface.

I claim:

1. A system of brackets and platforms for supporting a keyboard and mouse to a chair comprising:

a pedestal bracket adapted to be fixedly interposed between a pedestal and a seat portion of said chair, said pedestal bracket having a tube which slidably receives a tubular main support arm;

said main support arm adapted to extend laterally from said chair and having a sleeve fixed to an end thereof, said sleeve extending longitudinally transverse to said main support arm, said sleeve slidably receiving a forward adjustment tube;

said forward adjustment tube having a round sectioned swing arm sleeve fixed perpendicularly to one end thereof, said swing arm sleeve extending longitudinally in the up and down directions and slidably and rotatively receiving a round sectioned swing arm tube;

said swing arm tube having a table support tube fixed perpendicularly to an end thereof, said table support tube adapted to swing for angular adjustment in front of or to one side of an occupant of said chair, said table support tube slidably and rotatively receiving a keyboard platform for angular adjustment about a longitudinal axis of the table support tube.

2. The system of brackets and platforms of claim 1 wherein said pedestal bracket provides a means of adjustment enabling said pedestal bracket to be mounted to pedestals of varying size and shape.

3. The system of brackets and platforms of claim 1, said main support arm further receiving a mouse attachment bracket between said pedestal bracket and said round sectioned sleeve;

said mouse attachment bracket including means for connecting a mouse swing arm for angular adjustment of said mouse swing arm relative to the mouse attachment bracket;

said mouse swing arm receiving thereon one of a pair of adjustment cross sleeves for linear adjustment along said mouse swing arm;

the other of said pair of cross sleeves being fixed to said one of said pair and receiving a mouse support tube for linear height adjustment;

the mouse support tube having a mouse platform connected to a top end thereof, and means for angularly adjusting the mouse platform.

* * * * *